US008632425B2

(12) United States Patent
Madson et al.

(10) Patent No.: US 8,632,425 B2
(45) Date of Patent: Jan. 21, 2014

(54) GOLF BALL

(75) Inventors: Michael R. Madson, Pawtucket, RI (US); Nicholas M. Nardacci, Bristol, RI (US); Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 538 days.

(21) Appl. No.: 12/895,105

(22) Filed: Sep. 30, 2010

(65) Prior Publication Data

US 2012/0083365 A1 Apr. 5, 2012

(51) Int. Cl.
*A63B 37/12* (2006.01)

(52) U.S. Cl.
USPC ..... 473/383

(58) Field of Classification Search
USPC ..... 473/378–384
See application file for complete search history.

(56) References Cited

U.S. PATENT DOCUMENTS

| | | | | |
|---|---|---|---|---|
| 5,308,076 | A | 5/1994 | Sun | |
| 5,908,359 | A | 6/1999 | Shimosaka et al. | |
| 6,346,054 | B1 * | 2/2002 | Shimosaka et al. | 473/383 |
| 7,621,827 | B2 * | 11/2009 | Sajima | 473/379 |
| 2003/0232667 | A1 * | 12/2003 | Kasashima | 473/378 |
| 2010/0240473 | A1 | 9/2010 | Aoyama et al. | |

* cited by examiner

*Primary Examiner* — Raeann Gorden
(74) *Attorney, Agent, or Firm* — Mandi B. Milbank

(57) ABSTRACT

Golf balls including at least one modified dimple group are disclosed. The modified dimple group comprises one or more modified dimples forming an axially symmetric pattern about a Correction Area Centroid located on an axis of symmetry at a latitude greater than 0°, where 0° represents the hemispherical pole and 90° represents the equator. The modified dimples can be altered, for example, by changing dimple coverage, dimple diameter, dimple depth, dimple edge angle, dimple volume, dimple cross-sectional shape, and/or dimple plan shape. Such modifications preferably produce a golf ball that flies more consistently regardless of orientation when struck than a corresponding golf ball without such modifications.

19 Claims, 7 Drawing Sheets

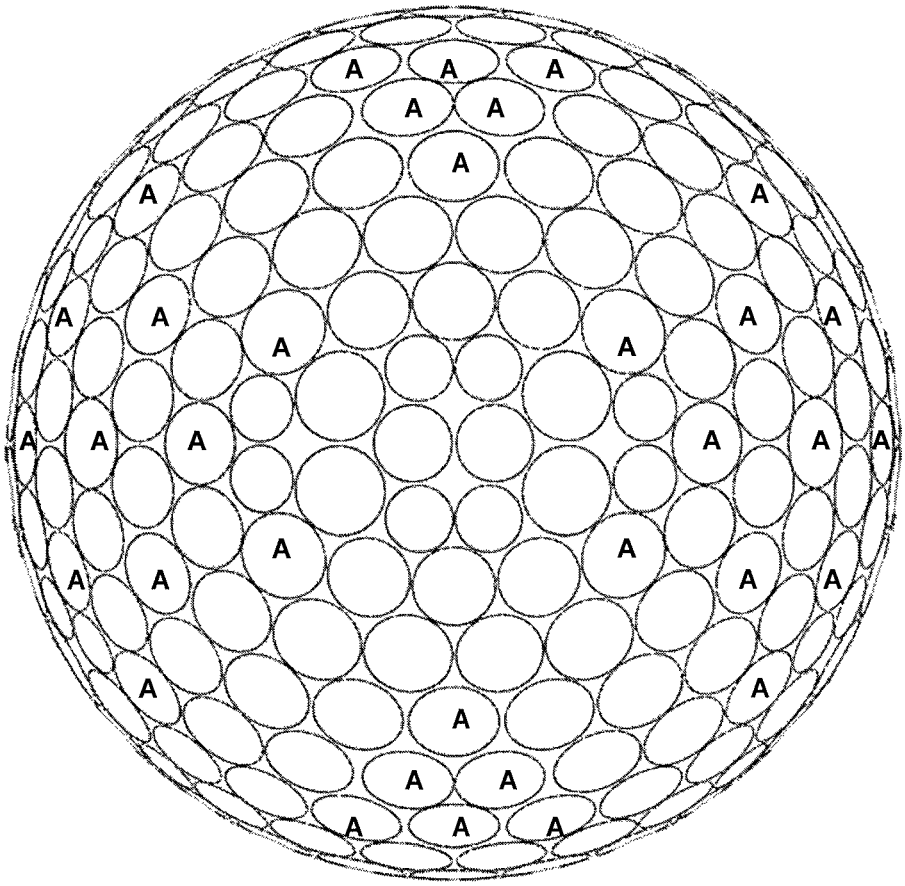
A A A
A A
A
A A
A A A A
A A A A A A
A A A A A A
A A

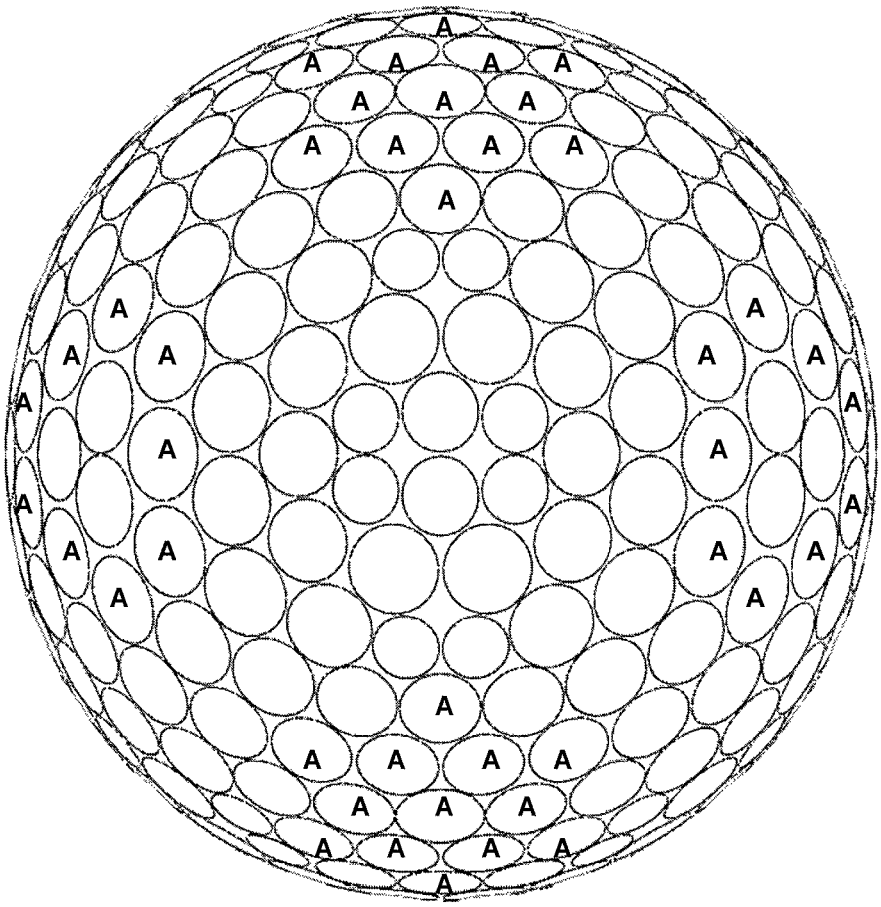
A
A A A A
A A A
A A A A
A
A A A A
A A A A
A A A

GOLF BALL

FIELD OF THE INVENTION

The present invention relates to golf balls, and more particularly, to golf balls having modified dimples that improve symmetric performance.

BACKGROUND OF THE INVENTION

Golf balls generally include a spherical outer surface with a plurality of dimples formed thereon. The dimples on a golf ball improve the aerodynamic characteristics of a golf ball and, therefore, golf ball manufacturers have researched dimple patterns, shape, volume, and cross-section in order to improve the aerodynamic performance of a golf ball. Determining specific dimple arrangements and dimple shapes that result in an aerodynamic advantage requires an understanding of how a golf ball travels through air.

When a golf ball travels through the air, the air surrounding the ball has different velocities and, thus, different pressures. The air develops a thin boundary layer adjacent to the ball's outer surface. The air exerts maximum pressure at a stagnation point on the front of the ball. The air then flows over the sides of the ball and has increased velocity and reduced pressure. The air separates from the surface of the ball at a top and a bottom separation point, leaving a large turbulent flow area called the wake that has low pressure. The difference in the high pressure in front of the ball and the low pressure behind the ball slows the ball down. This is the primary source of drag, which is the air resistance that acts on the golf ball in the direction opposite the ball's flight direction.

The dimples on a golf ball cause the thin boundary layer to flow in a turbulent manner. Rather than flowing in smooth, continuous layers (i.e., a laminar boundary layer), this turbulent boundary layer has a microscopic pattern of fluctuations and randomized flow. It is the circumference of each dimple, where the dimple wall drops away from the outer surface of the ball, which actually creates the turbulence in the boundary layer. The turbulence energizes the boundary layer and helps move the separation points further backward, so that the layer stays attached further along the ball's outer surface. As a result, there is a reduction in the area of the wake, increasing the average pressure behind the ball, and a substantial reduction in drag.

The shape of each dimple is also important in optimizing lift, which is an upward force on the ball that is created by a difference in pressure between the top of the ball and the bottom of the ball. This difference in pressure is created by a warp in the air flow that results from the ball's backspin. Due to the backspin, the top of the ball moves in the direction of the airflow, which shifts the top separation point to a location further backward. Conversely, the bottom of the ball moves against the air flow, which moves the bottom separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball.

By using dimples to decrease drag and increase lift, almost every golf ball manufacturer has increased their golf ball flight distances. However, a golf ball must meet certain standards in order to be included on the official Conforming Golf Balls List (the "List") produced by the United States Golf Association and The Royal and Ancient Golf Club of St. Andrews, Scotland, the two ruling bodies for the game of golf. Inclusion on the List is important for the commercial success of a golf ball, because it is a requirement for use in competitive golf, and because, even for recreational golf, most serious players won't use a ball unless it appears on the List.

One of the standards, commonly referred to as the "Symmetry Rule," specifies that a ball must fly essentially the same distance and for essentially the same amount of time regardless of how it is oriented when struck by the golf club. It is important for a ball to have this property not only for inclusion on the List, but also to ensure consistent performance in use. If a ball flies farther when oriented in a certain way, it would cause the golfer to hit the ball farther than intended if the ball happened to be oriented that way before being struck. Commercial golf balls may fly differently in particular orientations, mostly due to asymmetry in the dimple pattern resulting from the inclusion of a straight dimple-free path around the equator of the ball. This path, or "parting line" or "great circle" was necessary to provide a place for the two halves of the mold to separate during the molding process. The effect was worsened by abrasive buffing that was performed on the parting line to remove flash and other molding artifacts. It was discovered that the effect could be minimized or eliminated by altering a group of dimples centered at the pole of each hemisphere, usually by making them shallower.

Seamless balls have been developed which use a corrugated or staggered parting line that weaves around the dimples to disguise its presence and minimize the disruption to the dimple pattern. Although it was believed that this type of parting line would improve symmetry of flight, it was found that seamless balls do not always display satisfactory symmetrical flight performance.

Using modified dimples in polar regions of seamless golf balls has been proposed as a means of improving symmetry, as disclosed, for example, in U.S. Patent Application Publication No. 2010/0240473, the entire disclosure of which is hereby incorporated herein by reference.

SUMMARY OF THE INVENTION

In one embodiment, the present invention is directed to a golf ball comprising a modified dimple group on each hemisphere, on the outermost surface thereof. The modified dimple group has a geometric center located on a non-polar axis of symmetry and comprises one or more modified dimples forming an axially symmetric pattern.

In another embodiment, the present invention is directed to a golf ball comprising a first hemisphere and a second hemisphere identical to the first hemisphere. The first hemisphere comprises a first modified dimple group and a second modified dimple group. Each of the first and second modified dimple groups comprises one or more modified dimples forming an axially symmetric pattern and having a geometric center located on an axis of symmetry at a latitude angle of greater than 45°.

BRIEF DESCRIPTION OF THE DRAWINGS

In the accompanying drawings, which form a part of the specification and are to be read in conjunction therewith, and in which like reference numerals are used to indicate like parts in the various views:

FIG. 4 is a polar view of a golf ball having an arrangement of modified dimples according to another embodiment of the present invention.

FIG. 5 is a polar view of a golf ball having an arrangement of modified dimples according to another embodiment of the present invention.

DETAILED DESCRIPTION

Figure 1:
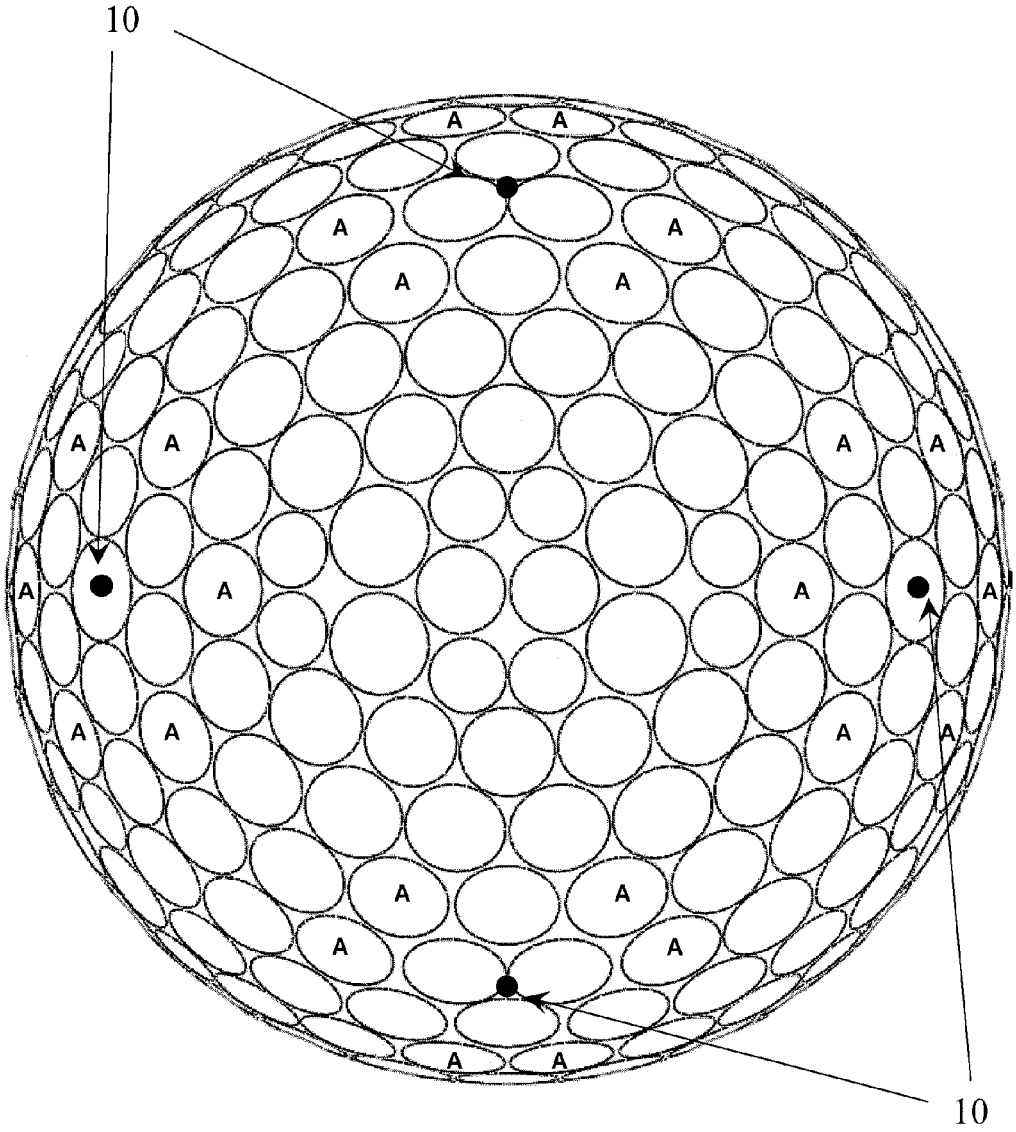
FIG. 1 is a polar view of a golf ball having an arrangement of modified dimples according to an embodiment of the present invention.

While the present invention is not meant to be limited by any particular pattern of the overall dimple arrangement, golf balls of the present invention preferably have an overall dimple pattern formed by generating one or more domains from a polyhedron, and tessellating the domain(s) over the ball, as disclosed, for example in U.S. Patent Application Publication No. 2010/0113187, the entire disclosure of which is hereby incorporated herein by reference. By arranging dimples in this manner, the symmetry of the underlying polyhedron is preserved and great circles due to parting lines are eliminated. The resulting overall dimple pattern has multiple axes of symmetry, typically including a polar symmetry axis and multiple non-polar symmetry axes. For purposes of the present disclosure, the symmetry axes are lines about which the overall dimple pattern can be rotated through some angle smaller than 360° which brings the pattern to a new orientation which appears identical to its starting position. The symmetry axes of an overall dimple pattern on a golf ball necessarily intersect at a common point at the center of the ball.

Golf balls of the present invention include, on each hemisphere of the ball, at least one modified dimple group having a geometric center, also referred to herein as a Correction Area Centroid ("CAC"), located on one of the multiple axes of symmetry in the overall dimple pattern, preferably a non-polar axis of symmetry. Preferably, the modified dimple group is located such that its CAC is located at a latitude angle ("$\phi_{CAC}$") of greater than 0°, or greater than 5°, or greater than 15°, or greater than 30°, or 45° or greater, or greater than 45°, or 50° or greater, or at a $\phi_{CAC}$ within a range having a lower limit of 5° or 15° or 30° or 35° or 40° or 45° and an upper limit of 55° or 60° or 65° or 75° or 80° or 90°, where 0° represents the hemispherical pole and 90° represents the equator.

Modified dimple groups of the present invention include groups of one or more modified dimples. For purposes of the present invention, the term "modified" means altered from the typical configuration based on the overall pattern of dimples on the ball, and the term "dimple" includes any texturizing on the surface of a golf ball, e.g., depressions and projections, which may have a variety of planform shapes, including, but not limited to, circular, polygonal, oval, or irregular shapes, and a variety of cross-sectional shapes, including, but not limited to, circular, catenary, elliptical, or conical shapes.

The approximate total number of dimples to be modified and the location of the modified dimple groups on the outermost surface of the ball are determined based on the flight performance of the ball prior to modifying dimples and the desired flight performance of the final product. Preferably, the same modifications are performed on both hemispheres of the ball, i.e., the ball consists of identical hemispheres.

The pattern of each modified dimple group can vary substantially, and the present invention is not meant to be limited by any particular pattern. Preferably, each modified dimple group has a pattern that is axially symmetric, i.e., symmetric about the axis of symmetry containing the group's CAC. In embodiments of the present invention wherein each hemisphere includes two or more modified dimple groups, the pattern formed by one group can be the same as or different than the pattern formed by another group.

While the degree of dimple modification depends on the ball's overall dimple pattern and the total number of dimples, the total number of modified dimples is preferably ¼ of the total number of dimples or less.

The modified dimples can be altered in any suitable manner, including, but not limited to, modifying diameter, depth, volume, edge angle, edge radius, cross-sectional shape, perimeter shape, and any combination of two or more thereof. In a particular embodiment, one or more dimple groups are modified in such a way as to make them less aggressive aerodynamically, such as by reducing dimple diameter, depth, volume, and/or edge angle. In another particular embodiment, one or more dimple groups are modified in such a way as to make them more aerodynamically aggressive, such as by increasing edge angle, volume, and/or by adding sub-dimples, i.e., dimples within a dimple. Sub-dimples are further disclosed, for example, in U.S. Pat. No. 6,569,038, the entire disclosure of which is hereby incorporated herein by reference.

For dimples modified by altering the edge angle, the difference in the edge angle between the majority of the dimples and the edge angle of the modified dimples is preferably 4° or less, more preferably from 1° to 3°.

The modified dimples can retain essentially the same appearance as or can be visually different from the unmodified dimples. Alterations that typically, but do not necessarily, result in modified dimples that retain essentially the same appearance as the unmodified dimples include, but are not limited to, changes to the dimple edge angle, depth, and volume, and moderate changes to the cross-sectional profile. Alterations that typically, but do not necessarily, result in modified dimples that are visually different from the unmodified dimples include, but are not limited to, changes to the dimple diameter, plan shape and size, and substantial changes to the cross-sectional profile. Dimples of the present invention having a modified depth preferably have a depth that is not greater than 90%, more preferably not greater than 80%, of the thickness of the outermost layer of the golf ball. Some dimples may be removed from the pattern by reducing their volume by about 100% to about zero. In this embodiment, by virtue of the types or magnitudes of the changes, the modified dimples are visually different from the unmodified dimples.

In embodiments of the present invention wherein each hemisphere includes two or more modified dimple groups, the dimples of one group may be altered in the same manner as or a different manner than another. Similarly, one dimple may be altered in the same or a different way than another dimple in the same dimple group.

Figure 2:
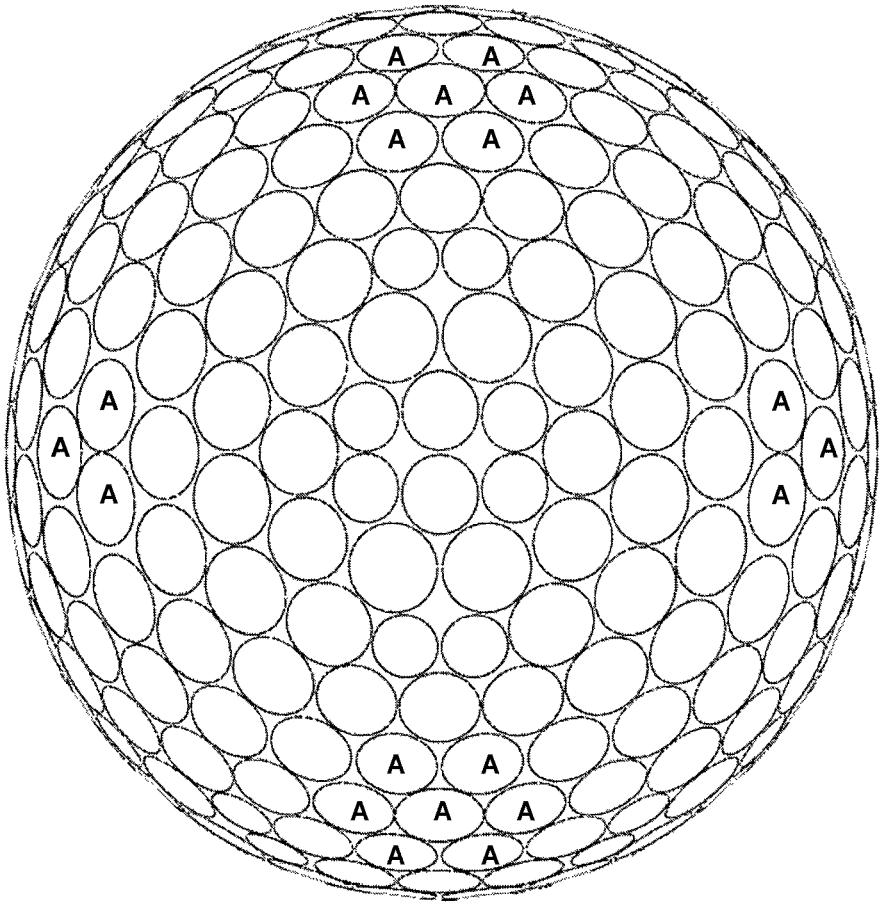
FIG. 2 is a polar view of a golf ball having an arrangement of modified dimples according to another embodiment of the present invention.
Figure 3:
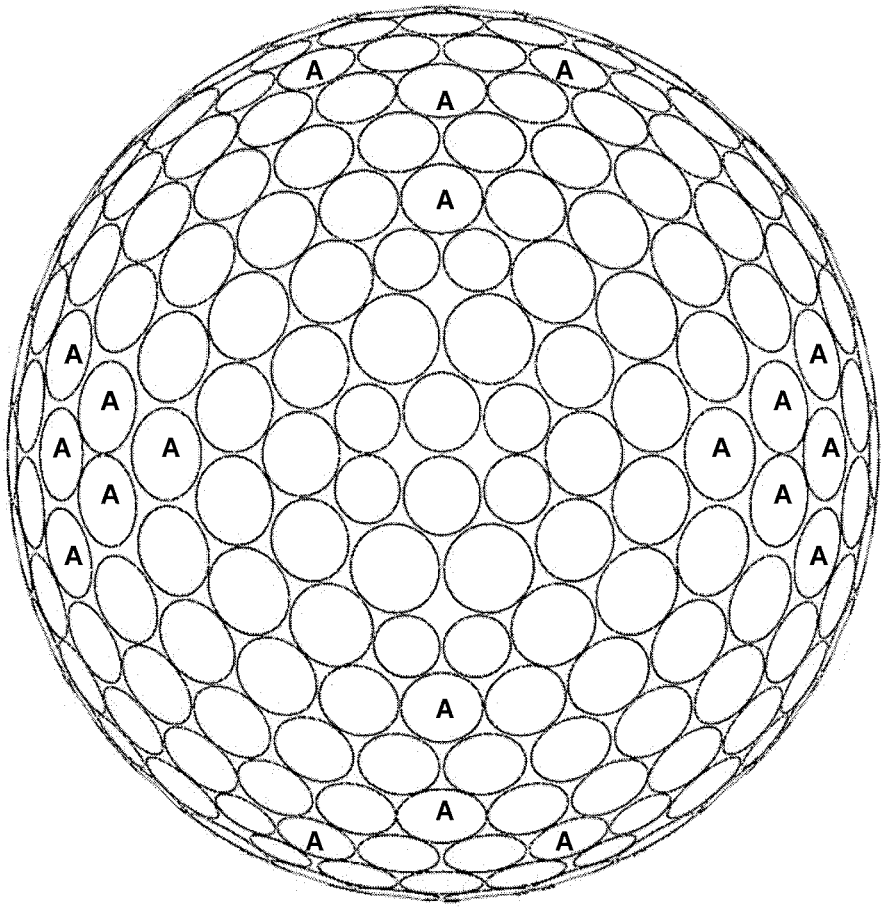
FIG. 3 is a polar view of a golf ball having an arrangement of modified dimples according to another embodiment of the present invention.

Referring now to the figures, FIGS. 1-5 illustrate the polar view of a seamless golf ball having 352 dimples arranged in a tetrahedron-based pattern, with modified dimples designated by the letter A. Each hemisphere of the ball can be divided by imaginary grid lines into two pairs of identical regions, each region having one modified dimple group arranged about a CAC 10 located on a non-polar axis of symmetry at a latitude angle of 54.7°. In FIG. 1, each region of one pair has a modified dimple group consisting of a set of three pairs of modified dimples, and each region of the other pair has a modified dimple group consisting of six modified dimples forming a hexagon. In FIG. 2, each region of one pair has a modified dimple group consisting of seven modified dimples forming a hexagon, and each region of the other pair has a modified dimple group consisting of three modified dimples forming a triangle. In FIG. 3, each region of one pair has a modified dimple group consisting of six modified dimples forming a triangle, and each region of the other pair has a modified dimple group consisting of three modified dimples forming a triangle and a modified dimple at or near the center of the triangle. FIGS. 4 and 5 illustrate two additional non-limiting examples of suitable patterns for modified dimples of the present invention.

Figure 6A:
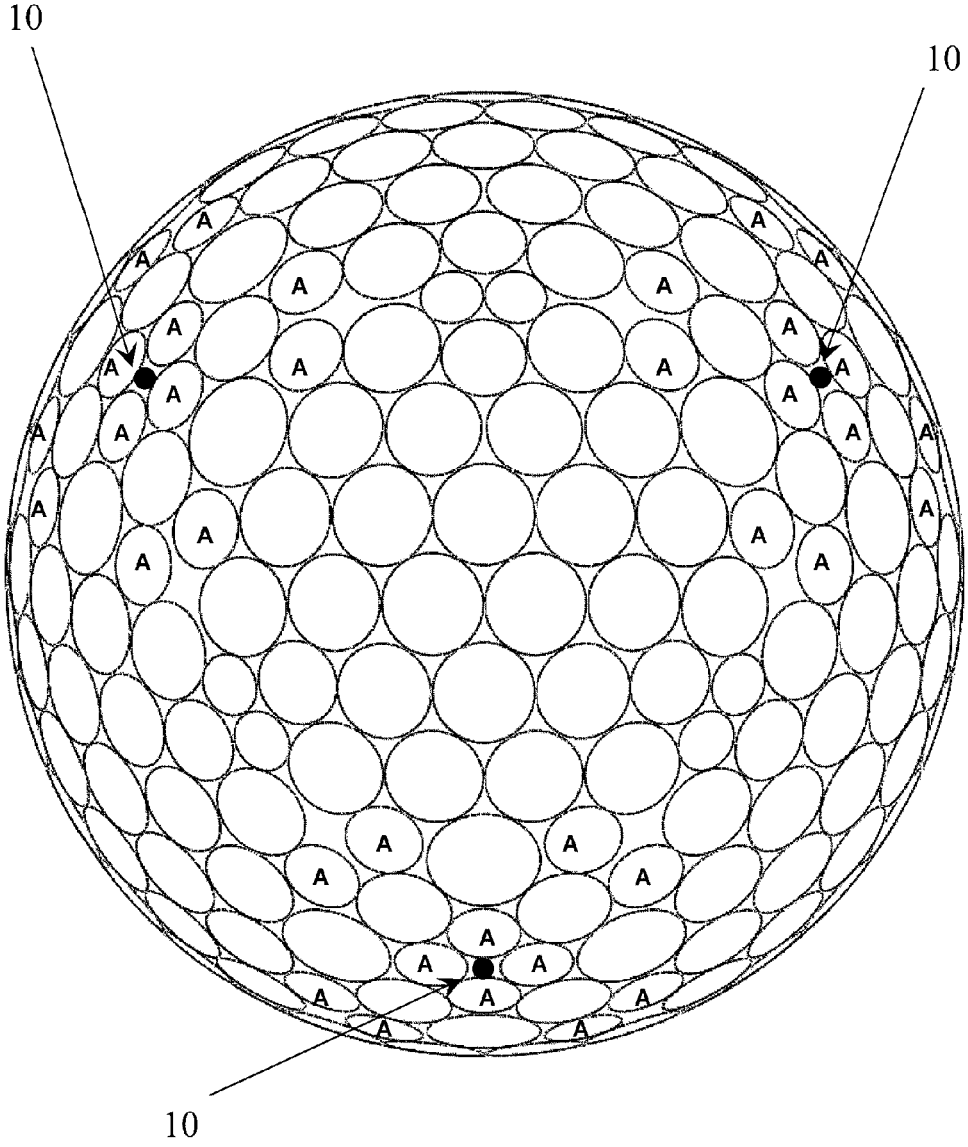
FIG. 6A is a polar view of a golf ball having an arrangement of modified dimples according to another embodiment of the present invention.
Figure 6B:
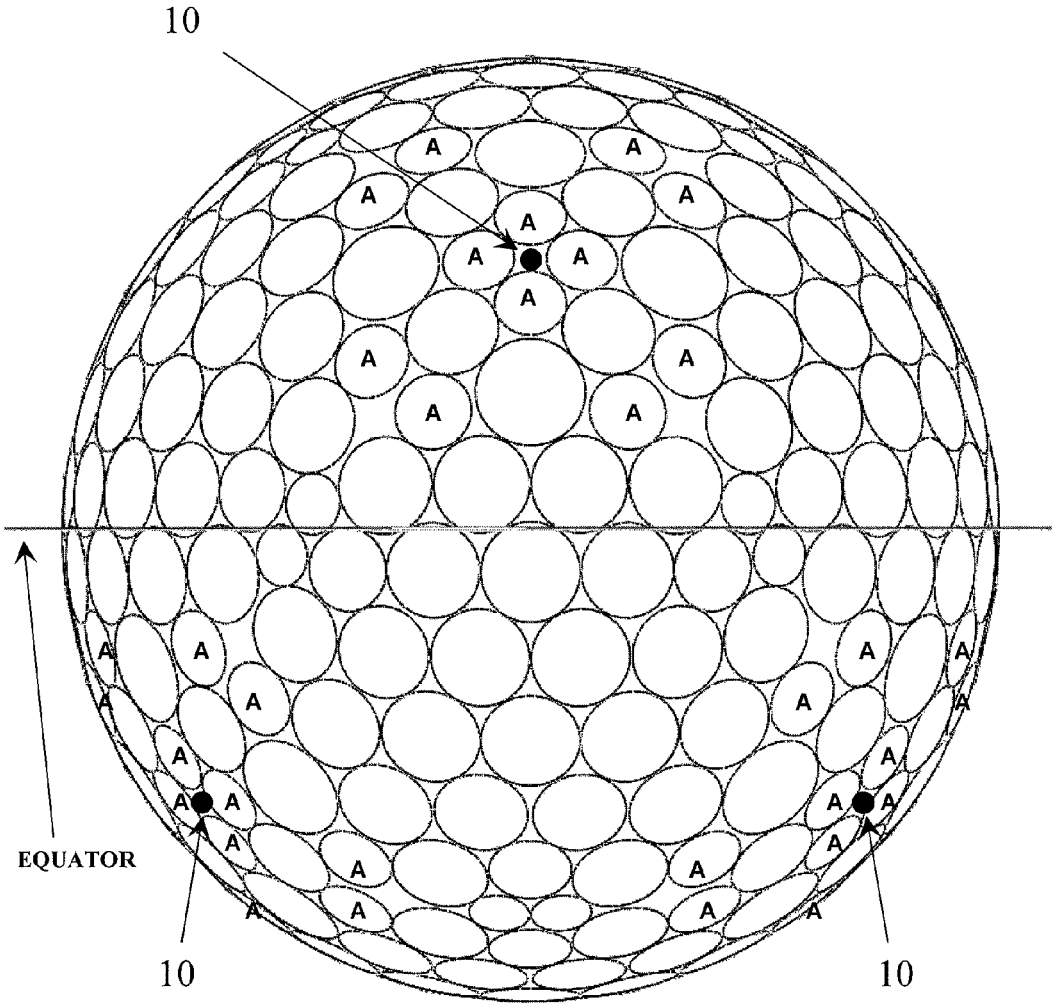
FIG. 6B is an equatorial view of the golf ball illustrated in FIG. 6A.

FIG. 6A illustrates the polar view of a seamless golf ball having 360 dimples arranged in a cuboctahedron-based pattern, with modified dimples designated by the letter A. Each hemisphere of the ball can be divided by imaginary grid lines into three identical regions, each region having one modified dimple group arranged about a CAC 10 located on a non-polar axis of symmetry at a latitude angle of 54.7°. The modified dimple group of each region consists of four modified dimples forming a square and a set of four pairs of modified dimples forming a square. FIG. 6B is an equatorial view of the golf ball illustrated in FIG. 6A.

Modifying dimples according to the present invention preferably produces a golf ball with improved flight symmetry compared to a corresponding golf ball without the modified dimples.

In a particular embodiment, the present invention is directed to a seamless golf ball, wherein the dimples have been modified using the dimple modification method disclosed herein. Seamless golf balls and methods of producing such are further disclosed, for example, in U.S. Pat. Nos. 6,849,007 and 7,422,529, the entire disclosures of which are hereby incorporated herein by reference.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having dimples on the outermost surface thereof, wherein the dimples consist of:

a majority of unmodified dimples having the same edge angle, and a plurality of modified dimples having an edge angle that is from 1° to 4° different than the edge angle of the unmodified dimples;

wherein the modified dimples are arranged in two or more groups, each group forming an axially symmetric pattern about a different geometric center; and wherein the geometric center of each group of modified dimples is located on a non-polar axis of the ball.

2. The golf ball of claim 1, wherein the geometric center of each group of modified dimples is located on an axis of the ball located at a latitude angle of greater than 5°.

3. The golf ball of claim 1, wherein the geometric center of each group of modified dimples is located on an axis of the ball located at a latitude angle of greater than 15°.

4. The golf ball of claim 1, wherein the geometric center of each group of modified dimples is located on an axis of the ball located at a latitude angle of greater than 30°.

5. The golf ball of claim 1, wherein the geometric center of each group of modified dimples is located on an axis of the ball located at a latitude angle of greater than 45°.

6. The golf ball of claim 1, wherein the geometric center of each group of modified dimples is located on an axis of the ball located at a latitude angle of greater than 50°.

7. A golf ball having dimples on the outermost surface thereof, wherein the dimples consist of:

a majority of unmodified dimples having the same edge angle, and a plurality of modified dimples having an edge angle that is from 1° to 4° different than the edge angle of the unmodified dimples;

wherein the modified dimples are arranged in six to eight groups, each group forming an axially symmetric pattern about a different geometric center; and wherein the geometric center of each group of modified dimples is located on a non-polar axis of the ball.

8. The golf ball of claim 7, wherein the geometric center of each group of modified dimples is located on an axis of the ball located at a latitude angle of greater than 5°.

9. The golf ball of claim 7, wherein the geometric center of each group of modified dimples is located on an axis of the ball located at a latitude angle of greater than 15°.

10. The golf ball of claim 7, wherein the geometric center of each group of modified dimples is located on an axis of the ball located at a latitude angle of greater than 30°.

11. The golf ball of claim 7, wherein the geometric center of each group of modified dimples is located on an axis of the ball located at a latitude angle of greater than 45°.

12. The golf ball of claim 7, wherein the geometric center of each group of modified dimples is located on an axis of the ball located at a latitude angle of greater than 50°.

13. The golf ball of claim 7, wherein the pattern of one group of modified dimples is different from the pattern of another group of modified dimples.

14. A golf ball having dimples on the outermost surface thereof, wherein the dimples consist of:

a majority of unmodified dimples having the same edge angle, and a plurality of modified dimples having an edge angle that is from 1° to 4° different than the edge angle of the unmodified dimples;

wherein the modified dimples are arranged in two or more groups, each group forming an axially symmetric pattern about a different geometric center;

wherein the geometric center of each group of modified dimples is located on a non-polar axis of the ball; and wherein the pattern of one group of modified dimples is different from the pattern of another group of modified dimples.

15. The golf ball of claim 14, wherein the geometric center of each group of modified dimples is located on an axis of the ball located at a latitude angle of greater than 5°.

16. The golf ball of claim 14, wherein the geometric center of each group of modified dimples is located on an axis of the ball located at a latitude angle of greater than 15°.

17. The golf ball of claim 14, wherein the geometric center of each group of modified dimples is located on an axis of the ball located at a latitude angle of greater than 30°.

18. The golf ball of claim 14, wherein the geometric center of each group of modified dimples is located on an axis of the ball located at a latitude angle of greater than 45°.

19. The golf ball of claim 14, wherein the geometric center of each group of modified dimples is located on an axis of the ball located at a latitude angle of greater than 50°.

* * * * *